United States Patent [19]

Dubois et al.

[11] 3,988,222

[45] Oct. 26, 1976

[54] METHOD OF FABRICATION OF ELECTROEMISSIVE COMPONENTS

[75] Inventors: Jacques Emile Dubois; Pierre Camille Lacaze, both of Paris; Claude Le Gressus, Fontenay le Fleury; Daniel Massignon, Paris, all of France

[73] Assignees: Commissariat a l'Energie Atomique, Paris; Agence Nationale de Valorisation de la Rocharche (ANVAR), Neuilly, both of France

[22] Filed: Jan. 21, 1975

[21] Appl. No.: 542,776

Related U.S. Application Data

[62] Division of Ser. No. 435,666, Jan. 23, 1974, Pat. No. 3,921,031.

[30] Foreign Application Priority Data

Jan. 30, 1973 France ..... 73.03212

[52] U.S. Cl. ..... 204/38 S; 204/192; 204/14 N; 204/23

[51] Int. Cl.[2] ..... C25D 5/48; C23C 15/00; C25D 3/02

[58] Field of Search ..... 204/14 N, 38 R, 38 S, 204/192

[56] References Cited

OTHER PUBLICATIONS

J. Electrochem. Soc., vol. 104, pp. 29–37 (1957).

J. Electrochem. Soc., vol. 104, pp. 38–41 (1957).

*Primary Examiner*—John H. Mack

*Assistant Examiner*—Aaron Weisstuch

*Attorney, Agent, or Firm*—Lane, Aitken, Dunner & Ziems

[57] ABSTRACT

An electroemissive component having variable emissivity is made up of a conductive substrate on which at least one continuous thin film of a solid organometallic compound has been formed by electrochemical deposition and of a conductive deposit constituted by at least one thin film and deposited on said organometallic film, the substrate and the conductive deposit being electrically connected respectively to the two poles of a variable-voltage source which controls the emissivity.

The component is particularly well suited to the fabrication of electronic or optoelectronic devices such as electron tubes, luminescent cells, display panels, thin television screens, and brightness amplifiers.

12 Claims, 11 Drawing Figures

FIG. 1
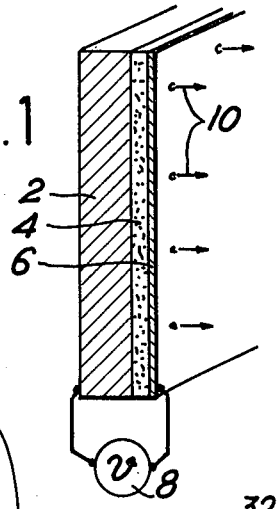
FIG. 2
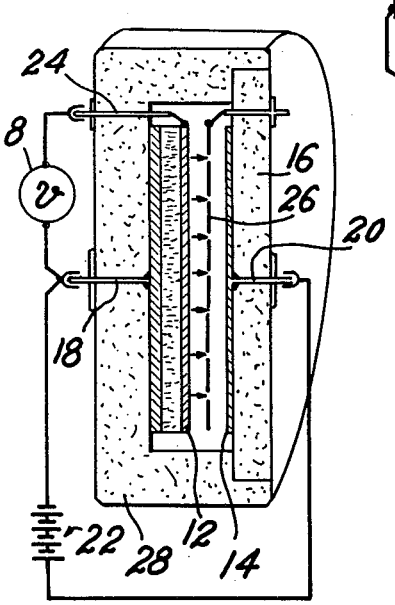
FIG. 3
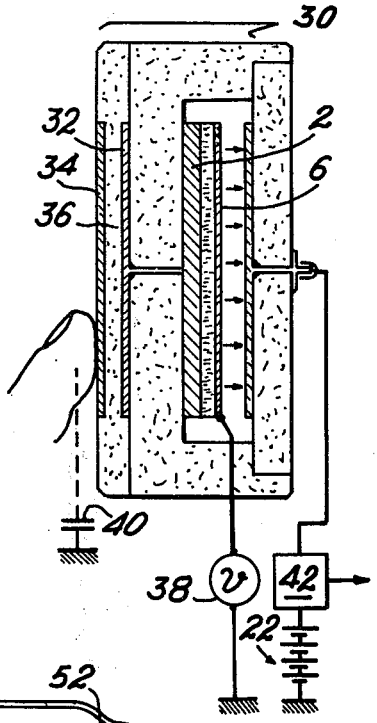
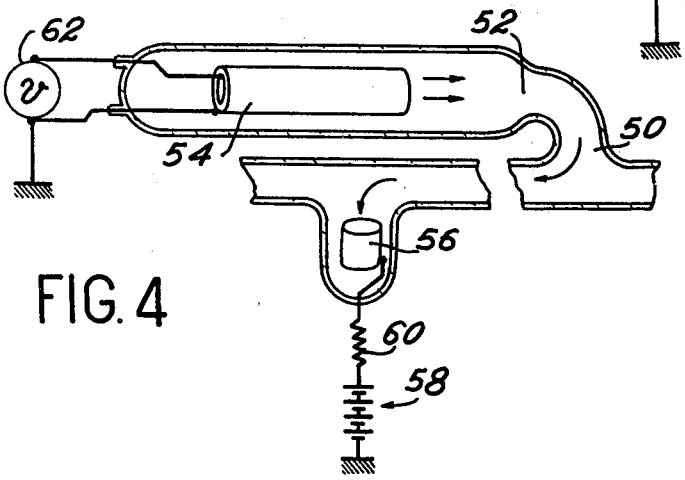
FIG. 4

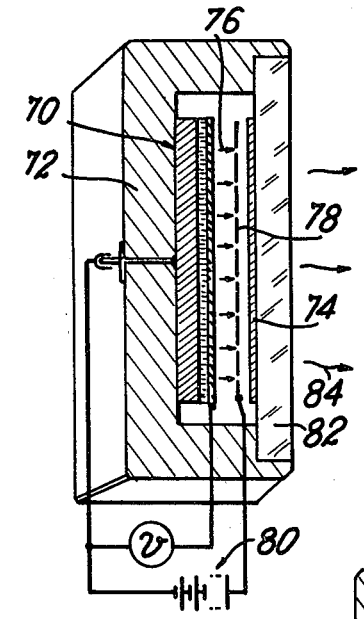
FIG.5
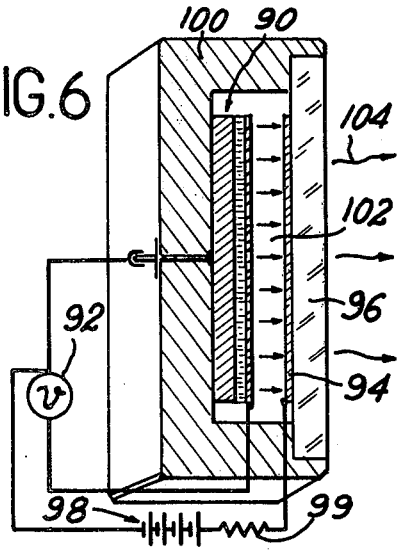
FIG.6
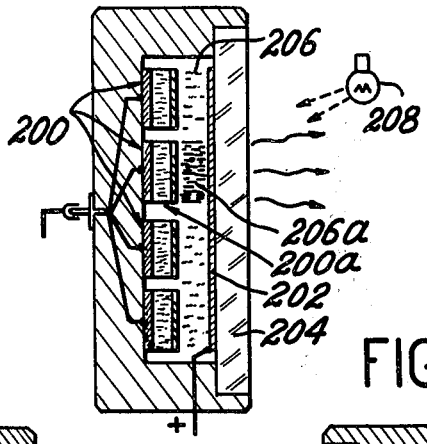
FIG.9
FIG.10
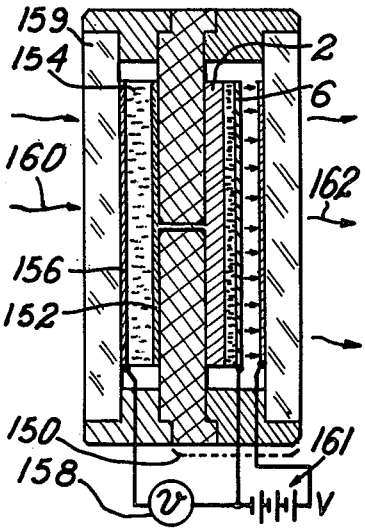
FIG.11
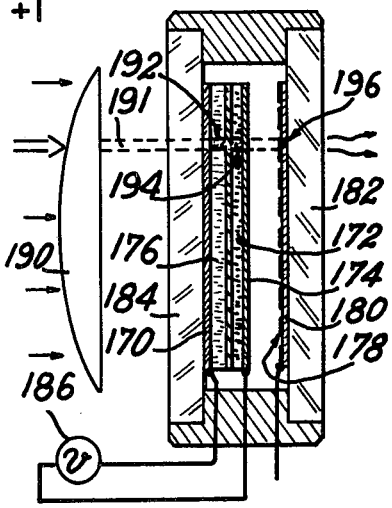

METHOD OF FABRICATION OF ELECTROEMISSIVE COMPONENTS

This is a division of application Ser. No. 435,666 filed Jan. 23, 1974, now U.S. Pat. No. 3,921,031.

This invention relates to an electroemissive component, to the method of fabrication of said component and to devices for the application of the method. Devices of this type are suitable for use in a very wide range of fields such as electron tubes, luminescent cells, display panels, thin television screens, brightness amplifiers and the like.

In precise terms, the invention is directed to an electroemissive component having variable emissivity and essentially constituted by a conductive substrate on which at least one continuous film of a solid organometallic compound having a thickness within the range of a few Angstrom to a few hundred Angstrom has been deposited by electrochemical means, and by a conductive deposit formed by at least one thin film and deposited on said organometallic film, said substrate and said conductive deposit being electrically connected respectively to the two poles of a variable-voltage source which controls the emissivity.

The voltage which serves to vary the emissivity is a low voltage of the order of a few volts, for example.

The substrate and the conductive deposit are preferably metals such as platinum, aluminum, gold, nickel or copper. In order to increase the surface area of the substrate and consequently the electron emission, said substrate can be porous and formed of sintered nickel, for example. The metal of the organometallic compound is advantageously an alkali metal or an alkaline-earth metal such as sodium, lithinum or calcium.

The invention is also directed to a method of fabrication of the electroemissive component thus defined, said method being characterized in that:

there is prepared a solution consisting of an organic solvent in which is dissolved an electrolyte which is a metal salt, traces of water being present in said solution in some cases, a conductive substrate is immersed in said solution, there is applied to said substrate a voltage of the same order of magnitude at absolute value as the discharge voltage of the metal ion of said salt, thus resulting in an electrochemical reduction reaction at the surface of the substrate and causing the formation of said organometallic film on said substrate, the substrate which is coated with said film is withdrawn from the solution, a thin conductive deposit is applied to said film-coating, said substrate and said conductive deposit are connected electrically to the terminals of a variable-voltage source.

In accordance with one preferred feature, when the substrate is platinum or copper, the applied voltage at absolute value can be either close to the passivation voltage or of the same order of magnitude as the voltage at the beginning of discharge of the salt.

In the case in which the substrate is of aluminum, the applied voltage at absolute value is close to the voltage at the beginning of discharge of the salt.

In accordance with another preferred feature, the solvent is either hexamethylphosphotriamide (known by the abbreviation HMPT) or tetrahydrofurane.

The formula of HMPT is as follows:

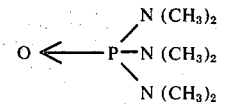

In accordance with yet another preferred feature, the electrolyte is a salt of an alkali metal or an alkaline-earth metal.

By way of indication, it is therefore possible to employ a solution of lithium perchlorate in HMPT and a platinum cathode.

The thickness of the organometallic film obtained by means of this method is a function on the one hand of the voltage applied to the cathode and on the other hand of the electrolysis time. For example, in the case of lithium perchlorate in a HMPT medium with a platinum electrode, there are obtained deposits which thicken very rapidly with the electrolysis time when a voltage of −3.8 V is applied with respect to a reference electrode of $10^{-2}$N Ag-$Ag^{+}$. In the case of a lower voltage of the order of −12.5 V, for example, the surface of the metal substrate retains its metallic brightness irrespective of the electrolysis time.

Although the scope of this invention is not dependent on the exactness of the following interpretation in any respect, it can reasonably be suggested by way of explanation that the organometallic deposit obtained by the method hereinabove described is due on the one hand to the discharge of the metal ion on the cathode and on the other hand to a reaction of the metal in the solvent which may be accompanied in some cases by the formation of complexes.

The deposition of the thin conductive film can be carried out by vacuum sputtering.

The properties of the component thus obtained and above all the possibility of obtaining a variable electron emission by means of a low voltage make this component particularly well suited to the construction of electronic or optoelectronic devices while making it possible to simplify and to improve the performances of these latter.

From this it follows that the electroemissive component of the invention can constitute the cathode of an electron tube of the vacuum or gas type; it can be employed in the fabrication of luminescent cells, the association of which serves to construct display panels or thin television screens; finally, the component can be employed in the construction of brightness amplifiers.

The properties and advantages of the electroemissive component and of the devices for the practical application thereof will in any case become more readily apparent from the following description of exemplified embodiments which are given by way of explanation without any limitation being implied, reference being made to the accompanying drawings, wherein:

FIG. 1 is a diagram of the electroemissive component according to the invention;

FIG. 2 illustrates a first example of application of the electroemissive component of FIG. 1 to the construction of an electron tube;

FIG. 3 shows an electronic influence shwitch involving the use of the electronic tube shown in FIG. 2;

FIG. 4 illustrates a further example of application of the electroemissive component of FIG. 1 to the construction of a cathode for a gas-discharge tube;

FIG. 5 illustrates an example of application of the electroemissive component to the construction of a luminescent cell having a photoemitting screen;

FIG. 6 is an alternative form of a luminescent cell in which a discharge through a gas is employed;

FIG. 9 is a diagrammatic sectional view of a display panel constituted by a mosaic of electroemissiive components associated with a liquid-crystal film;

FIG. 10 illustrates another example of application of the luminescent cell of FIG. 5 to the construction of a brightness-amplifying cell;

FIG. 11 is a sectional view showing a brightness-amplifying panel which makes use of the luminescent component of FIG. 5 associated with a photoconductive substance.

Figure 7:
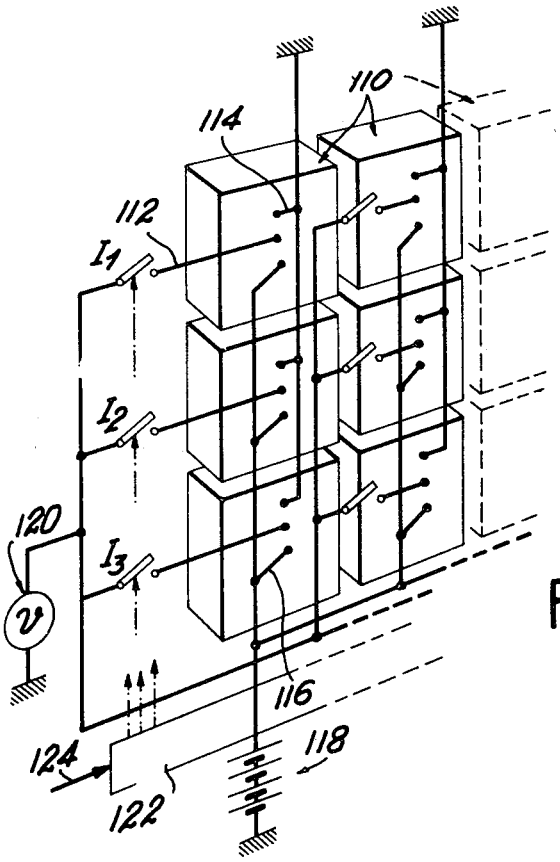
FIG. 7 shows a display panel constituted by a mosaic of luminescent cells in accordance with FIGS., 5 or 6.

The diagram of FIG. 1 shows the electroemissive component having variable emissivity in accordance with the invention (for enhanced clarity, the different elements have not been drawn to scale). Said component is constituted by a conductive substrate 2 on which a continuous film 4 of a solid organometallic compound having a thickness within the range of a few Angstroms to a few hundreds of Angstroms has been deposited by an electrochemical process in accordance with the method hereinabove defined. The component is also provided with a thin conductive deposit 6 which is applied on the film-layer 4. The substrate 2 and the deposit 6 are electrically connected to the two poles of a source 8 of variable voltage having an amplitude $v$. The inventors have found that a device of this type constitutes a source of electrons which are represented schematically by the arrows 10 in FIG. 1 and escape from the thin conductive component 6; the density of said electrons depends on the absolute value of the applied voltage $v$ and on the nature of the organometallic film.

Solely by way of explanation, the inventors have constructed among others the following components:

nature of the substrate 2 : platinum
thickness of the substrate 2 : 1 mm
thickness of the film 4 : a few tens of Angstroms starting from a solution of HMPT + $LiClO_4$
nature of the deposit 6 : gold,
thickness of the deposit 6 : 200 A
transverse dimensions : 2 mm × 2 mm.

In the case of the direct-current voltage $v$ of a few volts, the current emitted by said component associated with a positively-biased electrode for collecting the electrons was of the order of a few tens of microamperes.

The electron source aforesaid has a large number of advantages, and among these can be mentioned the following:

variable emissivity : this is achieved by means of a low voltage which is applied to the electrodes of the cpomponent and makes it possible to modulate the electron intensity; this property does not exist in any of the equivalent conventional devices (thermoemissive or cold cathodes) and is therefore unique;

considerable ruggedness: re-exposure to the surrounding air does not affect the emission of the source;

a lifetime of substantial length;

very low power consumption compared with hot cathodes of the direct or indirect heating type (a few microwatts);

no preheating period is required in order to obtain electron emission;

small overall size;

possibility of mass production;

low cost price as a consequence;

the size of the source, the nature of its components and the amplitude of the voltages required are such that the source is wholly suited to integrated circuits which may constitute the supply circuits.

The features noted in the foregoing show that it is particularly advantageous to employ the electroemissive component of FIG. 1 in the construction of electron tubes (vacuum or gas tubes) of the type shown by way of example in FIG. 2. In this figure, the electroemissive component is designated by the reference 12; a conductive film-layer 14 deposited on an insulating substrate 16 is located opposite to said component. Conductive passages 18 and 20 serve to connect the electroemissive device 12 and the conductive film 14 to the two terminals of a voltage source 22. The assembly 12 and the electrode 14 behave respectively as the cathode and the anode of a conventional electron tube. An additional passage 24 serves to establish the electrical connection which is inherent to the electroemissive component of the invention, that is to say to connect the conductive thin film to the source 8 which delivers the voltage $v$. Additional electrodes and especially grids 26 can be interposed between the electroemissive component 12 and the andoe 14. The complete assembly is contained within a vacuum-tight and insulating casing 28. The volume defined by said casing 28 and the substrate 16 can be either vacant or filled with a gas. The casing 28 and the substrate 16 can be either of glass or of ceramic material.

The electron tube of FIG. 2 is capable of operating in the same manner as conventional electron tubes of this type (diode, triode and the like or a switching tube of the thyratron type) but can also serve as an amplifier or as a switch by virtue of the specific property of its cathode, namely the variation of emissivity as a function of the applied voltage $v$. The function of triggering of the flow of current which is carried out in conventional tubes by applying a voltage to the grid can be performed directly by the cathode in the electron tube according to the invention without entailing any need to employ an intermediate grid. Moreover, since the emissivity is not dependent on the sign of the voltage $v$, an electron tube of this type can be employed for the purpose of rectifying an alternating-current voltage which is applied to the connections 18 and 24.

The tube of FIG. 2 is particularly well suited to the construction of an electronic influence switch of the type shown in FIG. 3. In this figure, there is again shown the electronic component of FIG. 2 which is designated by the reference 30. The substrate 2 of the electroemissive component is connected to a conductive film 32 which is separated from a second conductive film 34 by an insulator 36; the electroemissive component is connected to an alternating-current voltage source 38, one terminal of which is connected to ground. The conductive substrate 2 of the electroemissive component is therefore at a floating potential whereas the conductive thin film 6 is at the alternating-current potential supplied by the source 38. No electric field is therefore applied between the substrate 2 and the deposit 6. By approaching the hand or a conductive mass, the organometallic layer formed between the electrodes 2 and 6 can thus be activated through a very small capacitance 40 without giving rise to any galvanic conduction caused by the insulating layer 36. The electroemissive component is unblocked and a current appears in the anode circuit. If means 42 are provided for detecting the appearance of said current, there has thus been produced a switch of the influence type or alternatively of the "electronic key" type.

FIG. 4 illustrates a further example of utilization of the electroemissive component according to the invention as cathode for a gas-discharge tube. There is shown in this figure a discharge tube comprising a leak-tight enclosure 50 filled with a gas 52 and containing a cathode 54, an anode 56, biasing means 58 and a stabilizing resistor 60. Said discharge tube is characterized in that its cathode 54 is constituted by a metal cylinder, the organometallic film and the conductive deposit shown in FIG. 1 having been deposited either on the internal wall or on the external wall of said cylinder. Said cathode 54 is connected to a source 62 and this latter delivers a d.c. or a.c. voltage *v*, the amplitude of which determines the emissivity of the cathode.

A discharge tube of this type finds a particularly advantageous application in the construction of gas lasers (helium and neon lasers, for example), in which it is useful to make provision for a cathode having low power consumption since this has the effect of reducing temperature build-up therefore of reducing deformations and increasing the mechanical stability of the complete assembly. Moreover, if a regulated d.c. voltage source 62 is employed, the electron emission is consequently also regulated, thereby resulting in a highly stable discharge current having low noise and therefore in high stability of the laser emission.

FIG. 5 illustrates one example of application of the electroemissive component to the construction of a luminescent cell. In this figure, the electroemissive component bears the reference 70 and is attached to a support 72; there is placed opposite to said component a photoemissive film 74 which is responsive to the action of the electron bombardment 76 produced by the component 70 and which is deposited on the transparent substrate 82. Provision is made between said electroemissive component and said photoemissive film for a conductive grid 78 which is positively biased by means of a voltage source 80. The assembly consisting of the substrates 72 and 82 forms a leak-tight enclosure which makes it possible to maintain a vacuum within the interior of the cell.

The operation of this devide is as follows: when a voltage *v* is applied to the electrodes of the electroemissive component 70 and the grid 78 is positively biased by means of the source 80, an electron current 76 flows between the cathode and the grid. Said grid allows a part of the electrons to pass through and the photoemissive film 74 consequently receives electrons, thus resulting in luminescence of said film which is perceptible through the transparent support 82. Said luminescence 84 is a function of the voltage *v* which is applied to the electroemissive component 70.

By way of explanation, a particularly advantageous photoemissive substance which can be used to form the film 74 is zinc sulphide. It would be possible, however, for any one versed in the art to find other materials which would make it feasible to obtain a wide range of different colors. It is also possible to employ "phosphors" which are characterized by a long time of decay of luminescence after excitation, thus providing an afterglow cell.

There is shown in FIG. 6 an alternative design of luminescent cell in which the luminescence is no longer produced on a phogoemissive screen as in the case of the cell shown in FIG. 5 but by means of electron discharge through a gas. An electroemissive component 90 and its associated voltage source 92 is again shown in FIG. 6; there is placed opposite to said component a transparent conductive film 94 deposited on a substrate 96 which is also transparent; the positive pole of a direct-current voltage source 98 is connected to the conductive film 94 through a stabilizing resistor 99 and the negative pole of said source is connected to the component 90. a leak-tight casing 100 serves to maintain a gas 102 within the enclosure.

The operation of a cell of this type is as follows: under the action of the voltage *v* delivered by the source 92, electrons are emitted by the electroemissive component 90 in the direction of the anode 94 which is suitably biased by the voltage source 98. Said discharge causes luminescence of the gas 102 which is directly visible through the transparent support 96. As in the case of the cell shown in FIG. 5, the intensity of luminescence is a function of the applied voltage *v;* this intensity can therefore be regulated from the low-voltage source 92. The gas 102 can be either neon or mercury.

The luminescent cells of FIGS. 5 and 6 have a very large number of applications and can serve, for example, as indictor lamps which are triggered from a d.c. or a.c. low-voltage supply. In addition, since the luminosity is directly proportional to the current flowing within the cell which is a function of the voltage *v*, luminescent cells of this type can be employed for analog visualization of the amplitude of a continuous or slowly variable signal. Finally, these cells can be employed for the purpose of forming display panels as shown in FIGS. 7 and 8.

Figure 8:
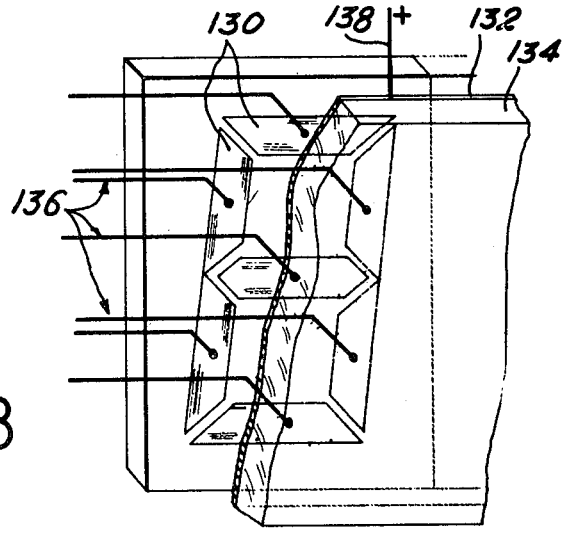
FIG. 8 is an alternative form of construction of a display device in which the elementary luminescent cells have the shape of segments which serve to carry out a numerical display.

The panel of FIG. 7 (Looking on the rear side) is constituted by a mosaic of luminescent cells 110 in accordance with either of the two alternative embodiments of FIGS. 5 and 6. Each cell 110 has three output leads 112, 114 and 116. The lead 116 serves to bias the anode of the luminescent cell (grid 78 in the case of the cell shown in FIG. 5, film 94 in the case of the cell shown in FIG. 6). All the leads 116 can be connected to the positive terminal of a voltage source 118. The leads 112 and 114 are the two leads which serve to apply an electric field in the organometallic film of each electroemissive component employed in the cells 110. By way of example, all the leads 114 can be connected to ground; the leads 112 are connected to a voltage source 120 through switches $I_1$, $I_2$, etc . . . which are controlled by a logic circuit 122. The signal of which one characteristic is to be indicated on the display panel formed by the mosaic of cells 110 is applied to said logic circuit through the input lead 124.

In this specification, it is not necessary to describe the control logic circuit 122 which serves to close or open the switches $I_1$, $I_2$, etc . . . in order to excite or not the corresponding cells and to display the desired alphanumeric or analog signs on the panel since a circuit of this type is conventional. However, it can be pointed out that, since a cell 110 is controlled from a low-voltage supply, the display panel of FIG. 7 can readily be controlled; in fact, the switches $I_1$, $I_2$ can be devices which operate at low voltage such as, for example, transistors, field-effect transistors, phototransistors, photoresistors, etc . . .

Again by reason of the possibility of employing a low voltage supply for controlling the cells 110, it is of particular interest to construct a display panel in which the conductive substrates of the electroemissive components of the different cells 110 are deposited on a support which is an integrated circuit and which can contain all the control circuits necessary for the excitation of the cells. In particular, said supporting integrated circuit can be designed in the form of a shift register, thereby simplifying the connections.

The panel which is illustrated in FIG. 7 permits the display of alphanumeric signs; but it can also constitute an analog imager in which the number of consecutive cells excited in a same column is directly proportional to the amplitude of the signal to be visualized, the transition from one column to the next being accompanied by the transition from one sample to the next of the quantity to be visualized. Any possible afterglow of the cell makes it possible to follow the time-variation of the quantity from one column to the next.

In this application, the cells operate on the all-or-none principle but the luminosity of the cell employed is substantially proportional to the amplitude of the applied voltage *v* in accordance with the invention and a convenient parameter is accordingly made available for producing an analog display in a different manner.

The panel of FIG. 7 can constitute in particular a thin television screen when the signal which appears on the lead 124 is a video frequency signal. Moreover, since the color of the luminescence emitted by the different cells depends essentially either on the gas contained in the cell or on the nature of the photoemissive film, the panel can contain a plurality of triads of cells of primary colors for the construction of a color television panel.

It is readily apparent that alternative forms of the panel shown in FIG. 7 can be fabricated by combining elements of like nature which form part of different luminescent cells. In particular, it is apparent from a study of FIG. 5 that the leak-tight casing 72, the transparent support 82, the conductive grid 78, the photoemissive film 74 can be a part of a single element formed in one piece and extending over the entire dimension of the panel. There is ony one condition to be observed and this is naturally the independence of each cell from the point of view of electrical control.

A second alternative design of display panel in accordance with the invention is illustrated in FIG. 8. In this figure, the panel comprises seven electroemissive components 130 having the shape of segments and grouped together in known manner so as to permit visual display of all the numerals from 0 to 9. There is placed opposite to said electroemissive components a conductive and transparent film 132 which is deposited on a transparent substrate 134; leads 136 serve to connect through switches (not shown) the different electroemissive components 130 to the low-voltage source which regulates the emissivity of said components. The film 132 is connected by means of the lead 138 to a source (not shown) which applies a positive bias to said film and causes this latter to perform the function of anode. A gas is contained in the space 140 between the electroemissive segments 130 and the film 132. The discharge through said gas is luminescent.

The judicious application of voltages to certain segments 130 results in the appearance of a luminescence of the gas to appear in the zones corresponding to the excited segments and initiates the display of a predetermined numerical sign through the transparent screen 134.

In the display device of FIG. 8, there are shown by way of explanation elements which are combined so as to form a single piece such as, for example, the transparent conductive film 132. It is wholly apparent that a similar display device could be formed by grouping together seven independent cells in the form of segments without thereby departing from the scope of the invention.

Any person who is versed in the art can readily conceive other display devices which are based in a general manner on the use of an electron current and a luminescent substance. A different device which is shown in FIG. 9 makes use of a substance which becomes diffusing at the time of passage of an electron current, namely a film of liquid crystals of the nematic type in the example under consideration.

In FIG. 9, the display panel comprises a plurality of electroemissive components 200 and a transparent conductive film 202 located in oppositely-facing relation and deposited on a transparent support 204. A film 206 of nematic liquid crystals is interposed between the components 200 and the film 202. The film 202 is connected to the positive terminal of a voltage source which is not shown in the figure. A control logic circuit (not shown) serves to apply suitable voltages to the components 200 in order to trigger the emission of these latter. The emission of a component (for example the component 200*a*) is accompanied by the flow of current through the liquid crystal, thus causing misalignment of the molecules of said crystal as a result of a known phenomenon. The liquid crystal zone 206*a* which is located opposite to the emitting component 200*a* then becomes diffusing. A light source 208 illuminates the front face 204; the observer sees the light diffused by the excited liquid crystal zone 206*a* which has a bright appearance on a dark background.

The electroemissive component in accordance with the invention is particularly well suited to this type of device since, as has already been noted, it calls for low control voltages. Moeover, the emitted currents are sufficient to induce the phenomenon of diffusion in liquid crystals.

The electroemissive component in accordance with the invention also lends itself very readily to the construction of brightness-amplifying devices, two examples of which are given in FIGS. 10 and 11.

In FIG. 10, there is shown in cross-section a brightness-amplifying cell consisting of a luminescent cell 150 (which in this instance can be similar to that sho in FIG. 5 but could also be the cell of FIG. 6). said cell being supplied from the source 161 of voltage *v*. The conductive substrate 2 is connected to a conductive film 152 on which there has been deposited a film 154 of photoconductive material which is in turn covered with a transparent conductive film 156. A transparent support 159 serves to close the device. The voltage source 158 is connected on the one hand to the conductive deposit 6 of the electroemissive component and on the other hand to the transparent conductive film 156.

The potential of the substrate 2 is directly dependent on the conduction of the phtotconductive film 154.

Said conduction depends on the luminous flux 160 which reaches the photoconductive substance 154 after having passed through the transparent support 159 and the conductive film 156. The intensity of the radiation 160 therefore determines the potential of the substrate 2 and consequently the emissivity of the electroemissive component. The luminous flux 162 emitted by the luminescent cell 150 is therefore directly related to the intensity of the incident radiation 160. The voltages *v* of the source 158 and V of the source 161 can always be regulated so as to ensure that the radiation 162 is of higher intensity than the incident radiation 160. A cell which is constructed in this manner thus constitutes a brightness amplifier.

On the basis of this elementary cell, a brightness-amplifying panel can be constituted as shown in FIG. 7 by assembling a plurality of cells in juxtaposed relation.

In a different form of construction, the brightness-amplifying panel contemplated by the invention is designed in accordance with FIG. 11. In this figure, the electroemissive component is again constituted by a conductive substrate 170 (but which is in this case transparent), by the film 172 of organometallic compound and by a conductive deposit 174. The substrate 170 is deposited on a transparent support 184. This electroemissive component further comprises a film 176 of photoconductive material interposed between the organometallic film 172 and the conductive substrate 170. The panel is completed by a grid 178 which is suitably biased by a voltage source (not shown) and by a photoemissive film 180 deposited on a transparent support 182. Leads serve to connect the conductive deposits 170 and 174 to a voltage source 186. An image is formed from a scene on the photoconductive film 176 by means of a lens 190.

The operation of said panel is as follows. The image produced by the lens 190 in the photoconductive film-layer 176 produces at each point of said layer a conductivity which is proportional to the luminous intensity at the point considered; for example at the point 192, the photoconductive substance has a given conductivity and the organometallic film is subjected at the corresponding point 194 to an electric field which is a direct function of the conductivity at the point 192. The emissivity at the point 194 is therefore related to the brightness of the image point 192. Within the photoemissive film-layer 180, the luminous point 196 which is located opposite to the point 194 has a brightness which is also dependent on the brightness of the point 192. The grid and cathode bias voltages can be chosen so that the luminous intensity emitted by the point 196 is higher than the intensity of the image point 192. There is therefore obtained on the photoemissive film 180 an image in which the brightness of the different points is greater than that of the points of the initial image.

Instead of projecting an image over the entire surface of the photoconductor, it is possible to employ an amplitude-modulated light beam 191 which defines the image sequentially line by line. The luminous intensity of the beam 191 determines the conduction of the photoconductor at the point of impact 192 and the luminescence of the point 196 at successive locations. If the image-by-image scanning is sufficiently rapid, the retinal persistence enables the observer to perceive the amplified total image without flickering.

What we claim is:

1. A method of fabrication of an electroemissive component comprising:

preparing a solution consisting of an organic solvent in which is dissolved a salt of an alkali metal or an alkaline earth metal, immersing a conductive substrate in said solution, applying to said substrate a voltage of the same order of magnitude at absolute value as the discharge voltage of said alkali metal or alkaline earth metal in solution, thereby causing an electrochemical reduction reaction at the surface of the substrate and causing the formation of a film on said substrate, withdrawing the substrate which is coated with said film from the solution, and applying a thin conductive deposit to said film.

2. A method according to claim 1, wherein said solvent is hexamethylphosphotriamide or tetrahydrofurane.

3. A method according to claim 1, wherein said salt is a lithium salt.

4. A method according to claim 1, wherein said electrolyte comprises a perchlorate.

5. A method according to claim 1, wherein said conductive deposit is formed by vacuum sputtering of a metal.

6. A method according to claim 1, wherein said solution contains traces of water.

7. A method of fabrication of an electroemissive component comprising:

preparing a solution consisting of an organic solvent in which is dissolved a salt of an alkali metal or an alkaline earth metal, immersing a conductive substrate in said solution, said conductive substrate having a passivation voltage, applying to said substrate a voltage of the same order of magnitude at absolute value as said passivation voltage of the substrate, thereby causing an electrochemical reduction reaction at the surface of the substrate and causing the formation of a film on said substrate, withdrawing the substrate which is coated with said film from the solution, and applying a thin conductive deposit to said film.

8. A method according to claim 7, wherein said solvent is hexamethylphosphotriamide or tetrahydrofurane.

9. A method according to claim 7, wherein said salt is a lithium salt.

10. A method according to claim 7, wherein said electrolyte comprises a perchlorate.

11. A method according to claim 7, wherein said conductive deposit is formed by vacuum sputtering of a metal.

12. A method according to claim 7, wherein said solution contains traces of water.

* * * * *